US005342010A

United States Patent [19]

Huang

[11] Patent Number: 5,342,010

[45] Date of Patent: Aug. 30, 1994

[54] CLAMPING DEVICE FOR AN ELONGATED PIECE

[75] Inventor: Chiu-Feng Huang, Taipei Hsien, Taiwan

[73] Assignee: Yamchen Industrial Co., Ltd., Taipei Hsien, Taiwan

[21] Appl. No.: 127,312

[22] Filed: Sep. 27, 1993

[51] Int. Cl.[5] ..... A47G 1/10

[52] U.S. Cl. ..... 248/316.3; 211/66; 248/110

[58] Field of Search ..... 248/110, 316.3, 111, 248/113; 211/63, 66, 68

[56] References Cited

U.S. PATENT DOCUMENTS

| | | | |
|---|---|---|---|
| 588,030 | 8/1897 | Swan | 248/113 |
| 1,485,092 | 2/1924 | Rauchut | 248/316.3 X |
| 1,494,252 | 5/1924 | Kane | 248/316.3 X |
| 1,674,581 | 6/1928 | Webb | 248/113 |
| 2,370,876 | 3/1945 | Richardson | 248/316.3 X |
| 2,869,209 | 1/1959 | Kautzky | 248/316.3 |
| 3,294,350 | 12/1966 | Grottola | 211/66 X |
| 3,422,960 | 1/1969 | Ell | 248/113 X |
| 4,134,499 | 1/1979 | Joswig | 211/66 |
| 5,165,629 | 11/1992 | Breveglieri | 248/110 |

FOREIGN PATENT DOCUMENTS

| | | | |
|---|---|---|---|
| 2739595 | 3/1979 | Fed. Rep. of Germany | 248/110 |

*Primary Examiner*—J. Franklin Foss

*Attorney, Agent, or Firm*—Christensen, O'Connor, Johnson & Kindness

[57] ABSTRACT

A clamping device includes two clamping units. At least one of the clamping units includes a sheave having a pinion portion biased toward the other of the clamping units so as to hold an elongated piece between the clamping units, and a rack member engaging the pinion portion of the sheave. Preferably, each of the clamping units has a frictional clamping surface which presses against the elongated piece.

16 Claims, 8 Drawing Sheets

CLAMPING DEVICE FOR AN ELONGATED PIECE

BACKGROUND OF THE INVENTION

1. Field of the Invention

This invention relates to a clamping device for an elongated piece, more particularly to a clamping device for clamping steadily an elongated piece.

2. Description of the Related Art

The improvement of this invention is directed to a conventional clamp device which includes a stationary unit, a guide unit spaced apart from the stationary unit at a predetermined distance, a movable unit mounted movably on the guide unit, and a bias unit interconnecting the guide unit and the movable unit so as to bias the movable unit to move toward the stationary unit, thereby holding an elongated piece between the stationary unit and the movable unit. However, the force exerted by the bias unit is insufficient to clamp effectively an elongated piece between the movable unit and the stationary unit.

SUMMARY OF THE INVENTION

The main objective of this invention is to provide a clamp device for clamping steadily an elongated piece.

According to an aspect of this invention, a clamp device includes a stationary unit, a guide unit spaced apart from the stationary unit at a predetermined distance, a movable unit mounted movably on the guide unit, and a bias unit. The guide unit includes a guide block and a rack member mounted securely on the top surface of the guide block. The movable unit includes a sheave which has two wheel portions and a pinion portion that is located between the wheel portions and that engages the rack member so as to guide the wheel portions of the sheave to move on the guide block. The bias unit interconnects the guide unit and the movable unit so as to bias the wheel portions of the sheave to move toward the stationary unit, thereby holding an elongated piece between the sheave and the stationary unit.

According to another aspect of this invention, a clamping device includes two spaced guide units, two movable units, and two bias units. Each of the guide units includes a guide block and a rack member which is mounted securely on the top surface of the guide block. Each of the movable units includes a sheave which has two wheel portions and a pinion portion that is located between the wheel portions and that engages a respective one of the rack members so as to guide the sheaves to move on the guide units. Each of the bias units interconnects one of the guide units and one of the movable units so as to bias the movable units to move toward each other, thereby holding an elongated piece between the movable units.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENT

Figure 1:
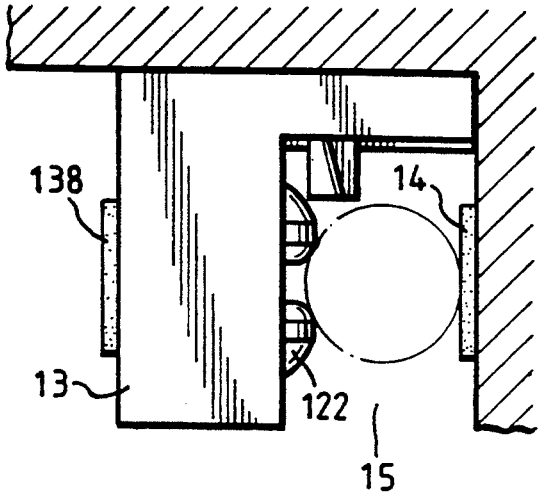
FIG. 1 is an elevational top view showing the first embodiment of the clamping device according to the invention.
Figure 2:
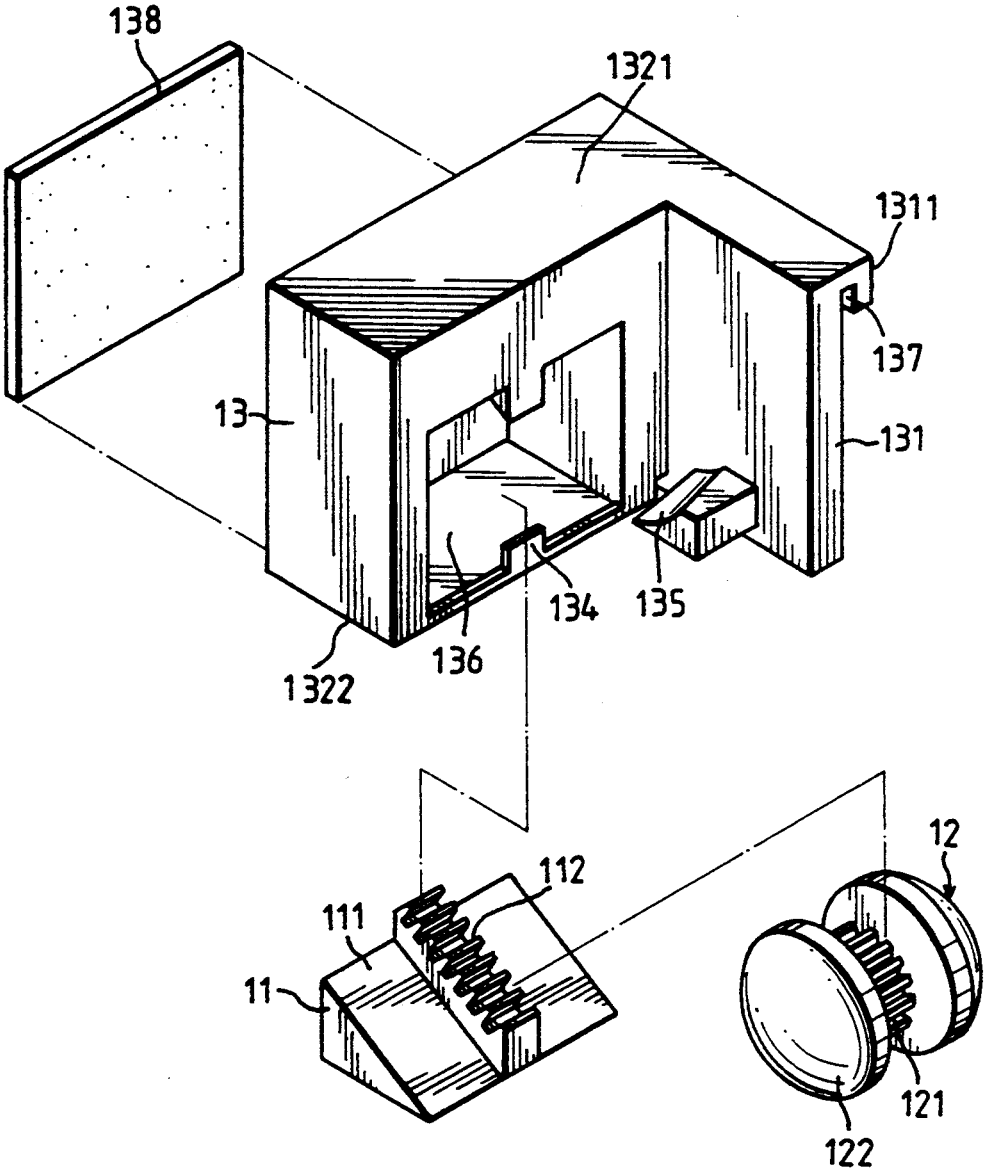
FIG. 2 is an exploded view showing the guide unit, the movable unit and the stationary shell body of the clamping device in accordance with this invention.

Referring to FIGS. 1 and 2, the clamping device of the first embodiment of this invention includes a stationary unit 14, a generally L-shaped stationary shell body 13 spaced apart from the stationary unit 14 at a predetermined distance so as to provide a clamping space 15 therebetween, a generally prism-shaped guide unit confined within the stationary shell body 13, and a movable unit or sheave 12 mounted movably on the guide unit.

The stationary shell body 13 has a vertical side wall 131, an L-shaped top wall 1311 extending from the rear portion of the top end of the vertical side wall 131 to define a groove 137 between the side wall 131 and the top wall 1311, a horizontal top wall 1321 extending from the front portion of the top end of the vertical side wall 131, and a horizontal bottom wall 1322 extending from the front portion of the bottom end of the vertical side wall 131. A recess 136 is formed in the shell body 13 between the top and bottom walls 1321, 1322. A vertical positioning plate 138 interconnects the top and bottom walls 1321, 1322 and is made of rubber so as to provide a frictional clamping surface. The stationary unit 14 has a frictional clamping surface which is similar to that of the vertical positioning plate 138 in construction.

The guide unit includes a guide block 11 which is confined in the recess 136 by a blocking plate 134 and which has an inclined flat top surface 111 and a rack member 112 mounted securely on the inclined flat top surface 111.

The sheave 12 has two wheel portions 122 and a pinion portion 121 that is located between the wheel portions 122 and that engages the rack member 112.

Figure 3:
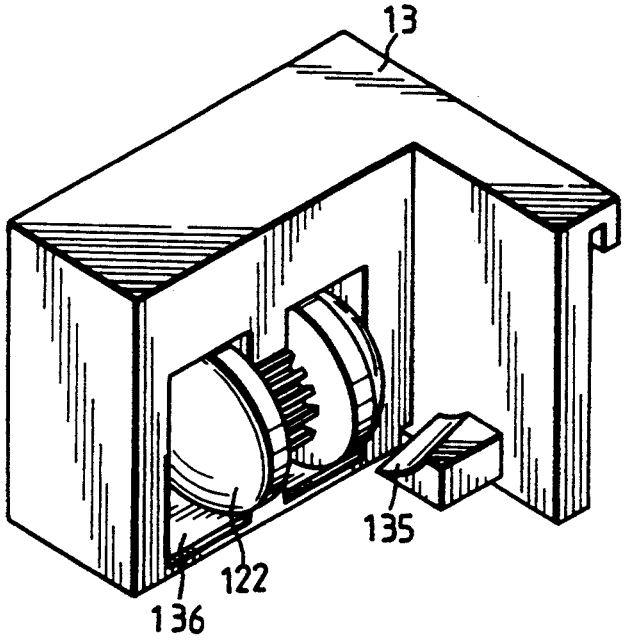
FIG. 3 is an assembled view of the guide unit, the movable unit and the stationary shell body of the clamping device of this invention.
Figure 6:
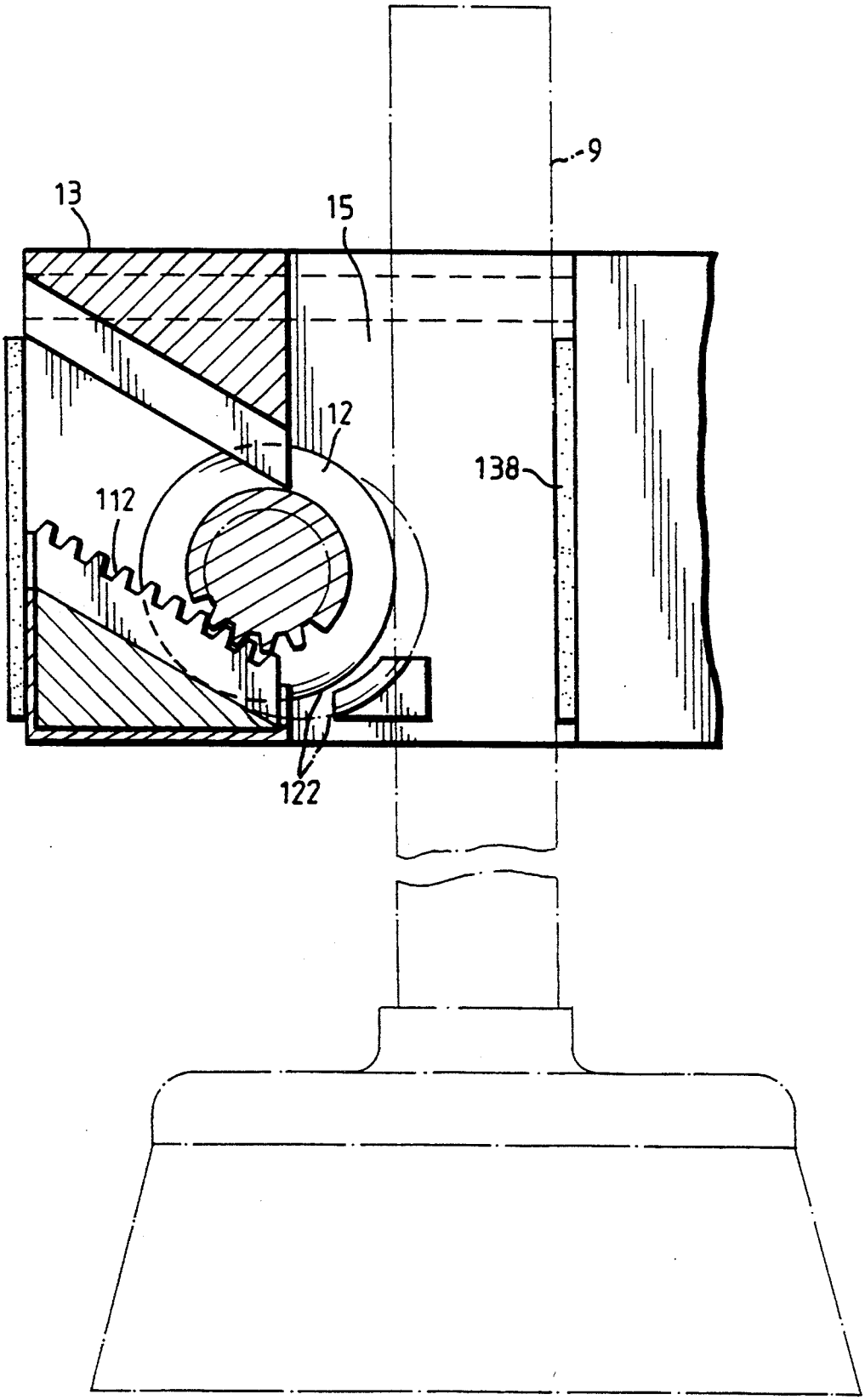
FIG. 6 is a schematic view illustrating the operation of the first embodiment of the clamping device in accordance with this invention.

The inclined flat top surface 111 of the guide block 11 functions as a bias unit so that the sheave 12 automatically moves toward the stationary unit 14 by virtue of gravity. The wheel portions 122 are made of rubber so as to provide frictional clamping surfaces. Accordingly, when the sheave 12 moves toward the stationary unit 14, the wheel portions 122 of the sheave 12 can protrude from the recess 136 of the shell body 13 so as to define a clamping space 15 (see FIG. 1) between the sheave 12 and the stationary unit 14, thereby firmly holding an elongated piece 9 between the wheel portions 122 of the sheave 12 and the stationary unit 14, as shown in FIG. 6. The shell body 13 further includes a block member 135 mounted securely on the lower end portion of the vertical positioning plate 131 near the recess 136 so as to prevent disengagement of the wheel portions 122 from the recess 136, as shown in FIG. 3. The sheave 12 and the guide unit constitute a clamping unit. The stationary unit 14 constitutes another clamping unit.

Figure 4:
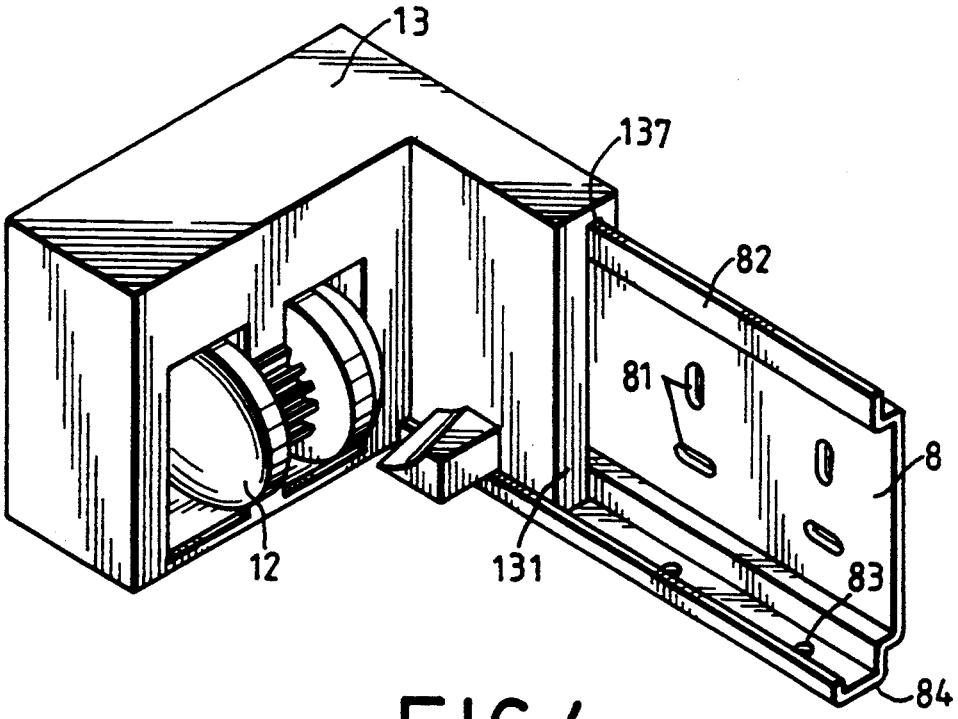
FIG. 4 illustrates the assembly of the guide unit, the movable unit and the stationary shell body which can be mounted movably on a wall.

Referring to FIG. 4, the clamping device further includes a positioning plate 8 which is mounted securely on a wall by means of several screws (not shown) that extend through holes 81 in the wall. The positioning plate 8 has an L-shaped guide flange 82 that projects from the top end of the positioning plate 8 so as to extend into the groove 137 of the shell body 13, and a support plate 84 that projects from the bottom end of the positioning plate 8 so as to support the vertical side wall 131 thereon and so as to fix the shell body 13 on the positioning plate 8 with the use of several screws (not shown) that extend through holes 83.

Figure 5:
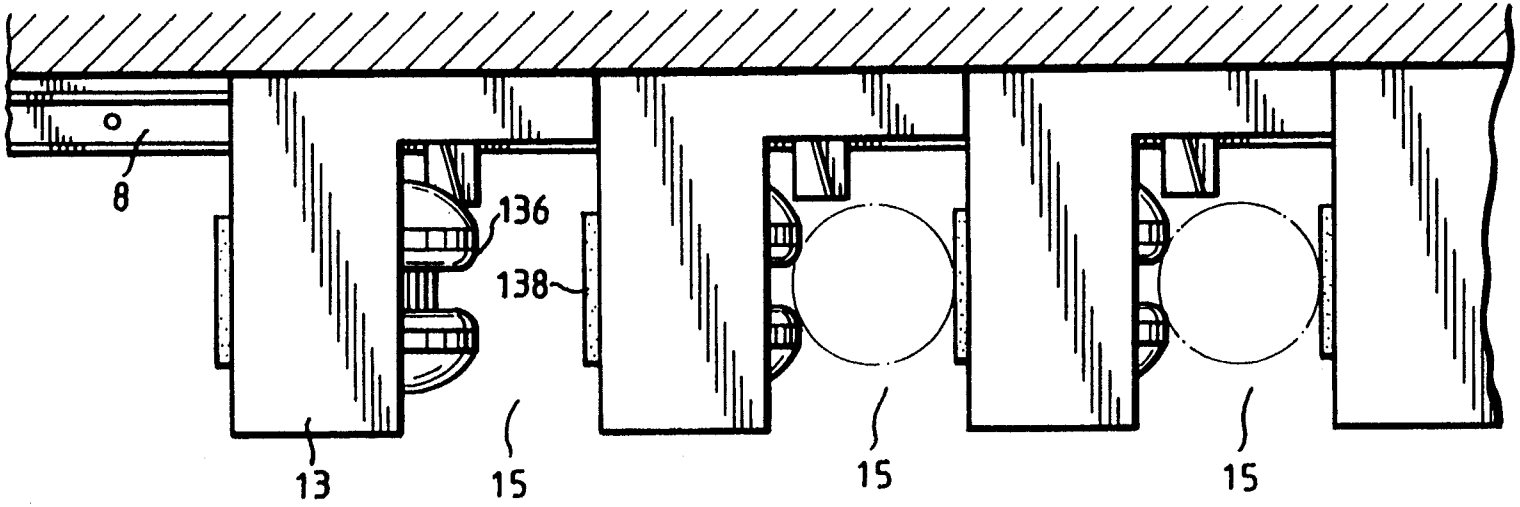
FIG. 5 illustrates the application of the first embodiment of the clamping device according to the invention.

FIG. 5 illustrates the application of the clamping device of the first embodiment of this invention. As illustrated a plurality of the clamping devices (only three are shown) are arranged in a row in such a manner that the shell bodies 13 are mounted on the positioning plate 8 and that in any adjacent pair of the shell bodies 13, the recess 136 of one of the shell bodies 13 faces the vertical positioning plate 138 of the other one of the shell bodies 13, thereby defining three clamping spaces 15 therebetween.

Referring to FIG. 6, one of the wheel portions 122 of the sheave 12 (indicated by phantom lines) presses against the block member 135 so as to prevent the disengagement of the sheave 12 from the shell body 13. When it is desired to clamp a broom 9 in the clamping space 15, the vertical rod portion of the broom 9 must be extended upwardly through the clamping space 15 so as to push the sheave 12 to roll upwardly along the rack member 112 of the guide block 11. Then, the sheave 12 moves toward the vertical positioning plate 138 by virtue of gravity so that the wheel portion 112 and the vertical positioning plate 138 press against the vertical rod portion of the broom 9. When the broom 9 falls slowly by virtue of gravity, the frictional force between the wheel portions 122 of the sheave 12 and the vertical rod portion can guide the sheave 12 to roll downwardly along the rack member 112. As a result, the more the broom 9 moves downwardly, the more the wheel portions 122 of the sheave 12 press against the vertical rod portion of the broom 9 due to the frictional force therebetween so as to firmly clamp the broom 9 in the clamping space 15. When it is desired to remove the broom 9 from the clamping space 15, the broom 9 is pushed upwardly so that the wheel portions 122 of the sheave 12 can roll upwardly along the rack member 112 due to the frictional force between the vertical rod portion of the broom 9 and the wheel portions 122 of the sheave 12, thereby permitting removal of the broom 9 from the clamping space 15.

Figure 6A:
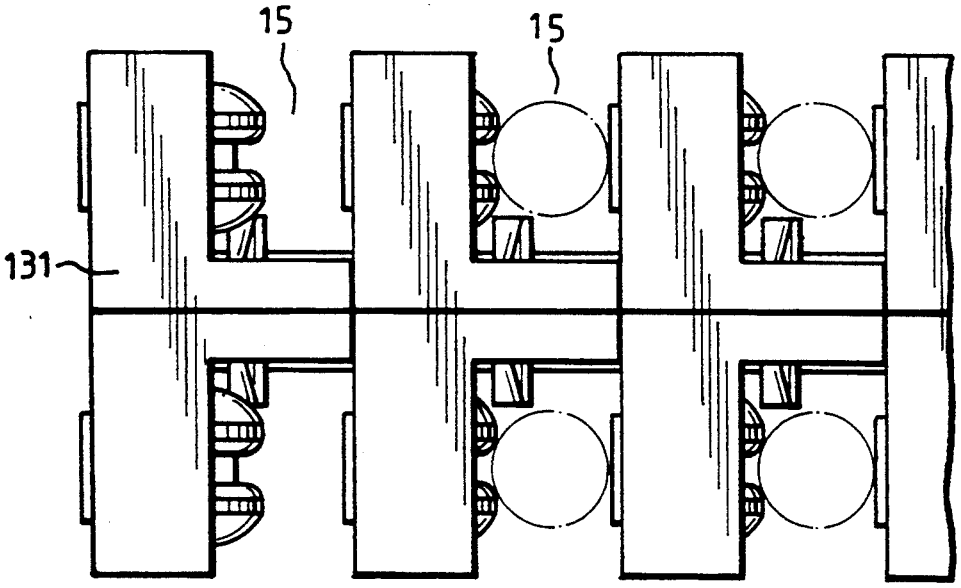
FIG. 6A illustrates the application of the first embodiment of the clamping device in accordance with this invention.

FIG. 6A illustrates the application of the clamping device of the first embodiment of this invention. As illustrated, there are several pairs of the clamping devices (only three pairs are shown) arranged in a row in such a manner that the vertical side walls 131 of each pair of the clamping devices abut against each other so as to define two rows of clamping spaces 15 therebetween.

Figure 7:
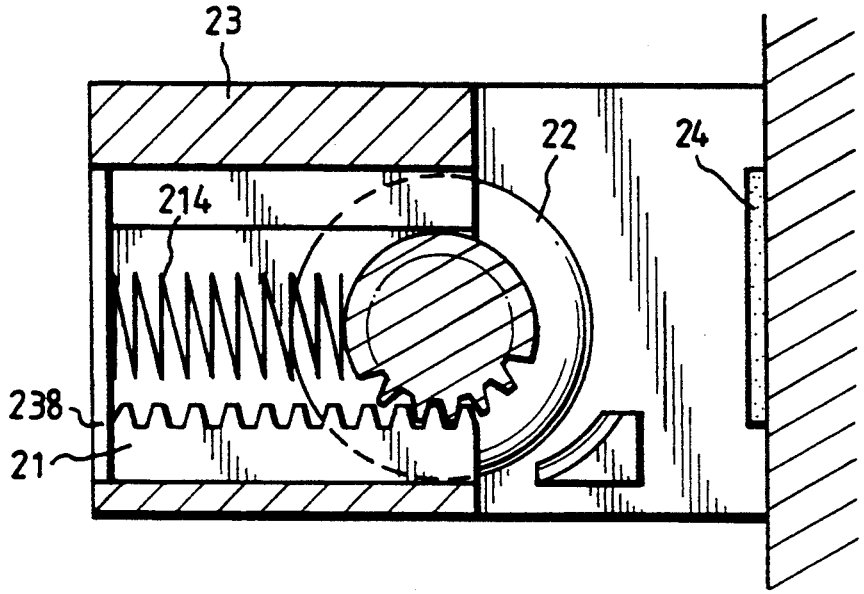
FIG. 7 is a schematic view of the second embodiment of the clamping device which has a spring element interconnecting the movable unit and the stationary shell body of the clamping device of this invention.

Referring to FIG. 7, the clamping device of the second embodiment of this invention includes a stationary unit 24, a stationary shell body 23, a sheave 22, and a guide block 21. The stationary unit 24, the shell body 23 and the sheave 22 are similar to those of the first embodiment in construction. The guide block 21 has a horizontal top surface on which a rack member lies, and a spring element 214 which interconnects the vertical positioning plate 238 of the shell body 23 so as to bias the sheave 22 to move toward the stationary unit 24.

Figure 8:
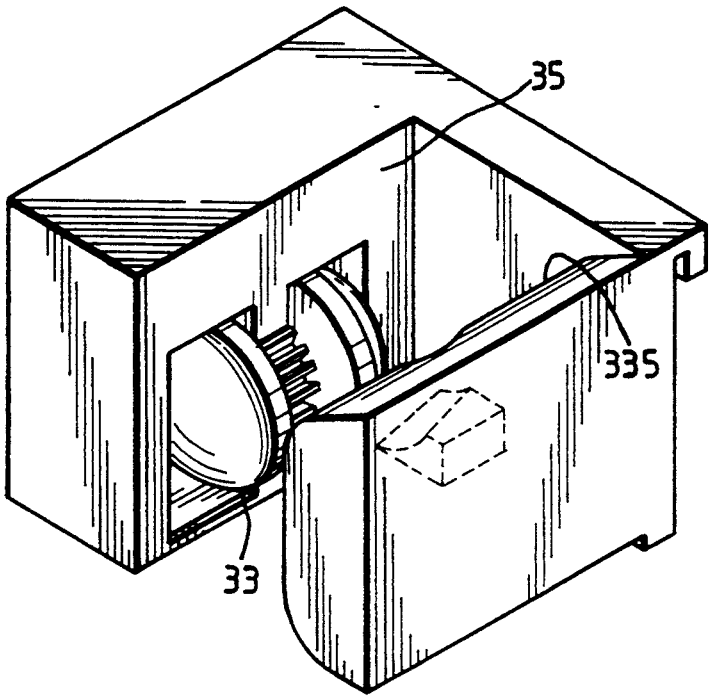
FIG. 8 is a perspective view of the third embodiment of the clamping device according to this invention.
Figure 9:
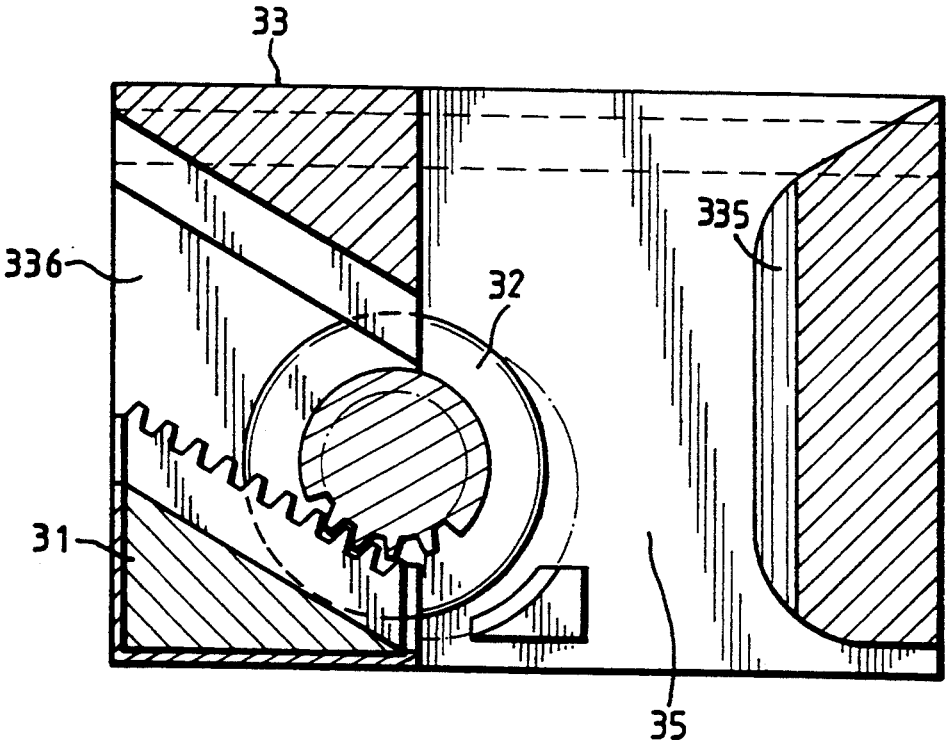
FIG. 9 is a sectional view showing the third embodiment of the clamping device in accordance with this invention.

Referring to FIGS. 8 and 9, the clamping device of the third embodiment of the invention includes a guide block 31, a sheave 32, and a stationary shell body 33. The guide block 31 and the sheave 32 are similar to those of the first embodiment in construction. The shell body 33 has a recess 336 so as to confine the guide block 31 and the sheave 32 therein, and a vertical positioning plate 335 which is mounted securely on the shell body 33 and which is spaced apart from the recess 336 of the shell body 33 at a predetermined distance so as to serve as a stationary unit, thereby defining a clamping space 35 between the recess 336 of the shell body 33 and the vertical positioning plate 335. Preferably, the vertical positioning plate 335 has a frictional clamping surface so as to hold steadily an elongated piece in the clamping space 35.

Figure 10:
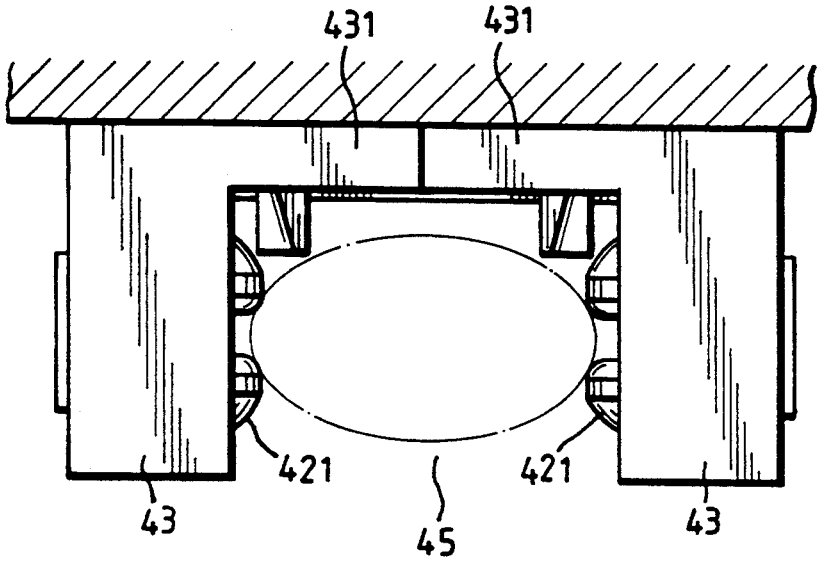
FIG. 10 is an elevational top view showing two associated assemblies of the guide unit, the movable unit and the stationary shell body according to the fourth embodiment of the clamping device of this invention.
Figure 11:
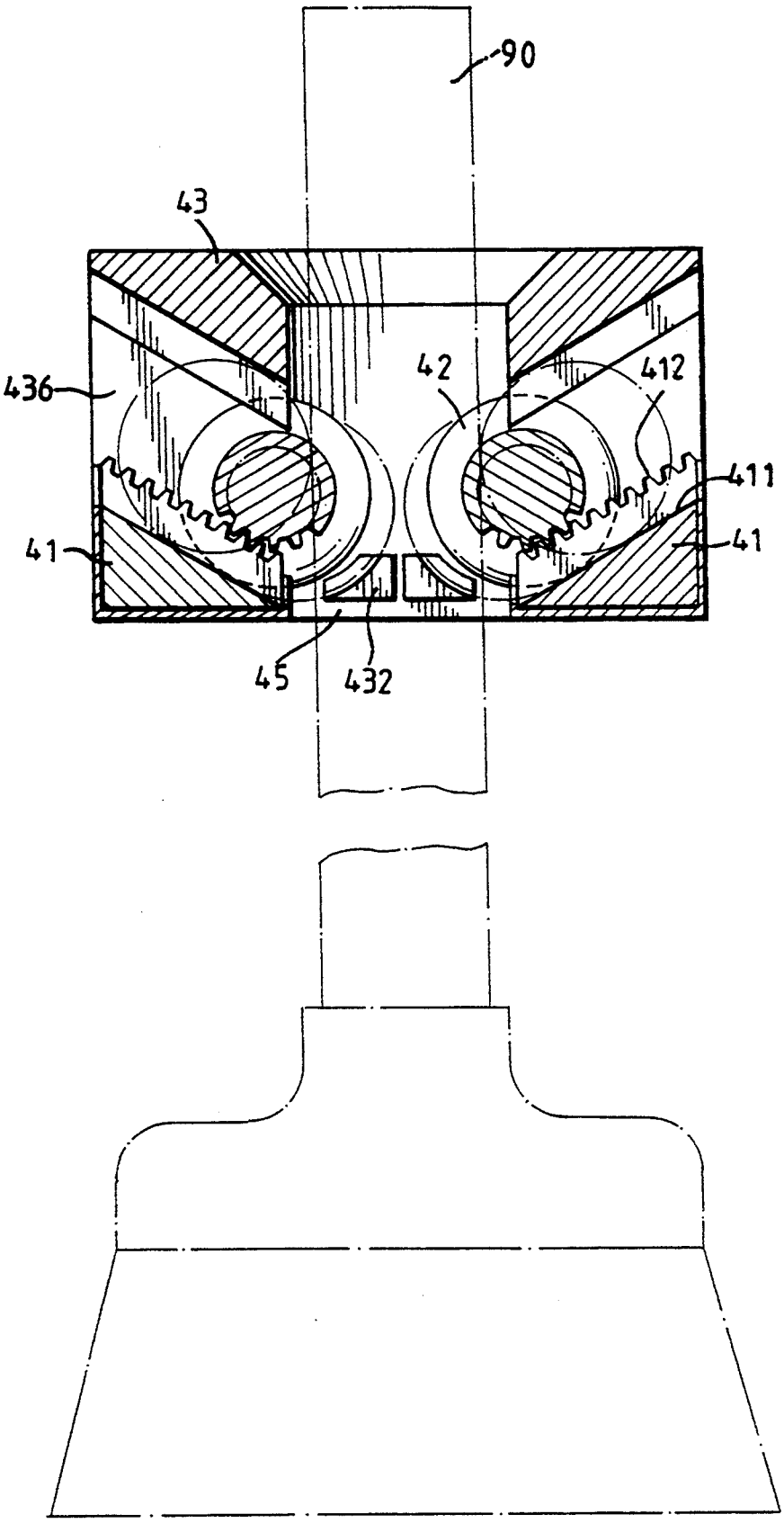
FIG. 11 is a schematic view illustrating the operation of the fourth embodiment of the clamping device according to this invention.

Referring to FIGS. 10 and 11, the clamping device of the fourth embodiment of this invention includes two generally L-shaped stationary shell bodies 43 spaced apart from each other at a predetermined distance, two guide units respectively confined within the shell bodies 43, and two movable units respectively and movably mounted on the guide units. Each of the shell bodies 43 is similar to that of the first embodiment in construction and has a vertical side wall 431 which is secured to a wall. Each of the vertical side walls 431 of the shell bodies 43 has a vertical end surface. The vertical end surfaces abut against each other so as to from a clamping space 45 between the shell bodies 43. Each of the guide units includes a guide block 41 confined within the recess 436 of the corresponding one of shell bodies 43. Each of the guide blocks 41 has an inclined flat top surface 411 and a rack member 412 which is mounted securely on the inclined flat top surface 411. Each of the movable units includes a sheave 42 which is similar to that of the first embodiment in construction so as to engage with the rack member 412 of a respective one of the guide blocks 41, thereby guiding the sheaves 42 to move toward each other.

Accordingly, when the sheaves 42 move toward each other, the wheel portions 421 of each of the sheaves 42 can protrude from the recess 436 of the corresponding one of the shell bodies 43 so as to hold an elongated piece 90 between the wheel portions 421 of the sheaves 42. Preferably, each of the wheel portions 421 of the sheaves 42 has a frictional clamping surface so as to hold steadily the elongated piece 90 in the clamping space 45.

Figure 12:
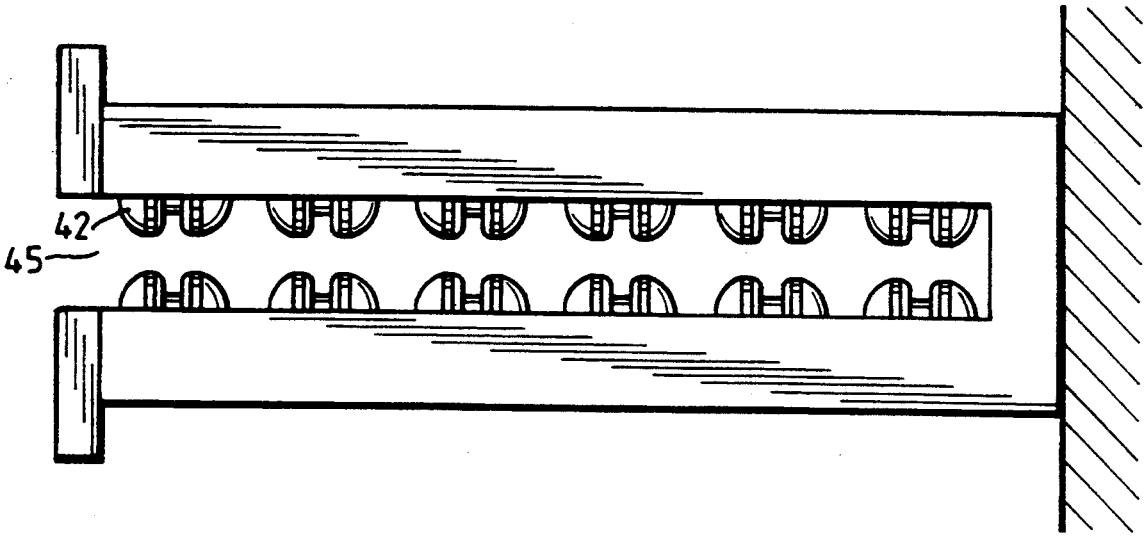
FIG. 12 illustrates the application of the fourth embodiment of the clamping device according to this invention.

FIG. 12 illustrates the application of the fourth embodiment of the clamping device of this invention. As illustrated, there are six clamping devices arranged in a row so as to define six clamping spaces 45 between the sheaves 42 of the clamping devices.

With this invention thus explained, it is apparent that numerous modifications and variations can be made without departing from the scope and spirit of this invention. It is therefore intended that this invention be limited only as indicated in the appended claims.

I claim:

1. A clamping device for an elongated piece, including a stationary unit, a guide unit spaced apart from said stationary unit at a predetermined distance, a movable unit mounted movably on said guide unit, and a bias unit interconnecting said guide unit and said movable unit so as to bias said movable unit to move toward said stationary unit, thereby holding said elongated piece between said stationary unit and said movable unit, wherein the improvement comprises:

said guide unit including a guide block and a rack member mounted securely on a top surface of said guide block; and said movable unit including a sheave which has two wheel portions and a pinion portion that is located between said wheel portions and that engages said rack member so as to guide said wheel portions of said sheave to move on said guide unit.

2. A clamping device as claimed in claim 1, wherein said guide block has an inclined flat top surface on which said rack member lies so that, when said sheave is placed on said inclined flat top surface of said guide block, said sheave automatically moves toward said stationary unit by virtue of gravity.

3. A clamping device as claimed in claim 1, wherein said bias unit includes a spring element which interconnects said guide block and said movable unit so as to bias said movable unit to move toward said stationary unit.

4. A clamping device as claimed in claim 1, wherein each of said wheel portions of said movable unit has an outer side wall which has a curved surface formed thereon.

5. A clamping device as claimed in claim 1, wherein said clamping device further includes a stationary shell body spaced apart from said stationary unit, said shell body having a vertical side wall adapted to abut against and to be secured to a wall, a horizontal top wall extending from a top end of said vertical side wall, a horizontal bottom wall extending from a bottom end of said vertical side wall, a vertical positioning plate interconnecting said top and bottom walls and being perpendicular to said vertical side wall, and a recess formed in said shell body between said top and bottom walls so that said guide unit is confined in said recess;

whereby, when said sheave moves toward said stationary unit, said wheel portions of said sheave can protrude from said recess of said shell body so as to hold said elongated piece between said wheel portions of said sheave and said stationary unit.

6. A clamping device as claimed in claim 5, wherein said stationary unit includes a vertical positioning plate which is mounted securely on said wall and is spaced apart from said recess of said shell body, thereby providing a clamping space between said recess of said shell body and said positioning plate.

7. A clamping device as claimed in claim 5, wherein said stationary unit is similar to said shell body in construction so as to clamp said elongated piece between said sheave of said shell body and said positioning plate of said stationary unit.

8. A clamping device as claimed in claim 5, wherein said vertical positioning plate of said shell body has a frictional clamping surface formed thereon.

9. A clamping device as claimed in claim 1, wherein each of said wheel portions of said sheave has a frictional clamping surface formed thereon.

10. A clamping device as claimed in claim 1, wherein the guide unit is adjustably spaced to a plurality of predetermined distances from said stationary unit.

11. A clamping device as claimed in claim 10, further comprising a positioning plate for mounting the guide unit thereto, said guide unit being mountable to said positioning plate at a plurality of locations for adjusting the distance between said guide unit and said stationary unit.

12. A clamping device for an elongated piece, including two spaced guide units, two movable units respectively and movably mounted on said guide units, and two bias units, each of which interconnecting one of said guide units and one of said movable units so as to bias said movable units to move toward each other, thereby holding said elongated piece between said movable units, wherein the improvement comprises:

each of said guide units including a guide block and a rack member which is mounted securely on a top surface of said guide block; and each of said movable units including a sheave which has two wheel portions and a pinion portion that is located between said wheel portions and that is engaged with a respective one of said rack members so as to guide said sheaves to move toward each other on said guide units.

13. A clamping device as claimed in claim 12, wherein each said guide block has an inclined flat top surface on which a corresponding said rack member lies so that, when each said sheave is placed on a respective one of said inclined flat top surfaces, said sheaves automatically move toward each other by virtue of gravity.

14. A clamping device as claimed in claim 12, wherein said wheel portions of each of said movable units have curved outer surfaces formed thereon.

15. A clamping device as claimed in claim 12, wherein said clamping device further includes two shell bodies spaced apart from each other, each of said shell bodies having a vertical side wall adapted to abut against and to be secured to a wall, a horizontal top wall extending from a top end of said vertical side wall, a horizontal bottom wall extending from a bottom end of said vertical side wall, a vertical positioning plate interconnecting said top and bottom walls and being perpendicular to said vertical side wall, and a recess formed in said shell body between said top and bottom walls so that said guide units are respectively confined in said recesses of said shell bodies;

whereby, when said sheaves move toward each other, said wheel portions of each of said sheaves can protrude from said recess of a corresponding one of said shell bodies so as to hold said elongated piece between said wheel portions of said sheaves.

16. A clamping device as .claimed in claim 12, wherein each of said wheel portions of said sheaves has a frictional clamping surface thereon so as to hold steadily said elongated piece between said sheaves.

* * * * *